US009928953B2

(12) United States Patent
Jeon et al.

(10) Patent No.: US 9,928,953 B2
(45) Date of Patent: Mar. 27, 2018

(54) COIL COMPONENT AND METHOD OF MANUFACTURING THE SAME

(71) Applicant: SAMSUNG ELECTRO-MECHANICS CO., LTD., Suwon-si, Gyeonggi-do (KR)

(72) Inventors: Hyung Jin Jeon, Suwon-si (KR); Jung Wook Seo, Suwon-si (KR); Eun Hye Na, Suwon-si (KR)

(73) Assignee: SAMSUNG ELECTRO-MECHANICS CO., LTD., Suwon-si, Gyeonggi-Do (KR)

( * ) Notice: Subject to any disclaimer, the term of this patent is extended or adjusted under 35 U.S.C. 154(b) by 0 days.

(21) Appl. No.: 14/973,110

(22) Filed: Dec. 17, 2015

(65) Prior Publication Data

US 2016/0189852 A1 Jun. 30, 2016

(30) Foreign Application Priority Data

Dec. 30, 2014 (KR) ..... 10-2014-0193234

(51) Int. Cl.

| | |
|---|---|
| ***H01F 5/00*** | (2006.01) |
| ***H01F 27/28*** | (2006.01) |
| ***H01F 27/255*** | (2006.01) |
| ***H01F 27/29*** | (2006.01) |
| ***H01F 41/04*** | (2006.01) |

(52) U.S. Cl.

CPC ..... *H01F 27/2804* (2013.01); *H01F 27/255* (2013.01); *H01F 27/292* (2013.01); *H01F 41/046* (2013.01); *H01F 2027/2809* (2013.01)

(58) Field of Classification Search

USPC ..... 336/233, 200

See application file for complete search history.

(56) References Cited

U.S. PATENT DOCUMENTS

| | | | | |
|---|---|---|---|---|
| 5,572,179 | A * | 11/1996 | Ito | H01F 17/0006 336/200 |
| 7,498,919 | B2 * | 3/2009 | Fujiwara | H01F 17/0033 336/200 |
| 8,416,047 | B2 * | 4/2013 | Weekamp | H01F 17/0006 336/200 |
| 8,866,579 | B2 * | 10/2014 | Hachiya | H01F 27/255 336/200 |
| 2005/0184848 | A1 | 8/2005 | Yoshida et al. | |
| 2009/0002117 | A1 * | 1/2009 | Kawarai | H01F 17/0006 336/233 |
| 2010/0033288 | A1 * | 2/2010 | Yokoyama | H01F 17/0013 336/200 |

(Continued)

FOREIGN PATENT DOCUMENTS

| | | |
|---|---|---|
| JP | 2005-243807 A | 9/2005 |
| JP | 2007-242800 A | 9/2007 |

(Continued)

*Primary Examiner* — Ronald Hinson

(74) *Attorney, Agent, or Firm* — McDermott Will & Emery LLP

(57) ABSTRACT

A coil component may include a core element, a coil conductor embedded in a surface of the core element, and a cover element bonded to the surface of the core element in which the coil conductor is embedded. Since the core element and the cover element are integrally formed, common failures, such as delamination or cracks, may be suppressed, and thereby product reliability may be improved.

14 Claims, 5 Drawing Sheets

(56) References Cited

U.S. PATENT DOCUMENTS

| | | | | |
|---|---|---|---|---|
| 2013/0214889 | A1 | 8/2013 | Kim et al. | |
| 2013/0278374 | A1* | 10/2013 | Thorslund ..... | H01F 27/2804 336/200 |
| 2014/0145796 | A1 | 5/2014 | Okumura et al. | |
| 2014/0285303 | A1 | 9/2014 | Cho et al. | |
| 2014/0285304 | A1 | 9/2014 | Yoo et al. | |

FOREIGN PATENT DOCUMENTS

| | | | |
|---|---|---|---|
| JP | 2014-107435 | A | 6/2014 |
| KR | 10-2013-0096026 | A | 8/2013 |
| KR | 10-2014-0116678 | A | 10/2014 |
| KR | 10-2014-0116679 | A | 10/2014 |

* cited by examiner

COIL COMPONENT AND METHOD OF MANUFACTURING THE SAME

CROSS-REFERENCE TO RELATED APPLICATION

This application claims benefit of priority to Korean Patent Application No. 10-2014-0193234 filed on Dec. 30, 2014, with the Korean Intellectual Property Office, the inventive concept of which is incorporated herein by reference.

TECHNICAL FIELD

The present inventive concept relates to a coil component, and more particularly, to a coil component having improved directionality and a method of fabricating the same.

BACKGROUND

Recently, electronic apparatuses, such as mobile phones, home appliances, personal computers (PCs), personal digital assistants (PDAs), LCDs, and navigation devices, have been increasingly digitized and increased in terms of processing speeds. Such apparatuses are sensitive to external stimuli. Accordingly, when even a small abnormal voltage or high frequency noise flows into an internal circuit of the electronic apparatuses from an external source, circuit failure or signal distortion may occur.

Such an abnormal voltage or high frequency noise may be caused by power noise included in a switching voltage or power voltage internally generated in the circuit, an unnecessary electromagnetic signal, an electromagnetic noise, or the like. In order to prevent such an abnormal voltage or high frequency noise from flowing into the circuit, coil components are widely used.

In particular, in the case of high speed interfaces, such as USB 2.0, USB 3.0, and high-definition multimedia interface (HDMI), a differential signal system transmitting a differential signal (a differential-mode signal) using a pair of signal lines may be employed, unlike a normal single-end transmitting system. In such a differential signal system, a common mode filter (CMF) is used as a coil component for removing common mode noise.

A normal CMF has a laminate structure including a ferrite substrate formed by sintering magnetic powder, a coil layer formed on the ferrite substrate, and a ferrite resin composite protecting the coil layer and preventing the leakage of magnetic flux formed in the coil layer.

Here, the ferrite resin composite is formed by mixing a magnetic powder and a resin. Accordingly, since the magnetic powder is dispersed in the resin, magnetic properties of the ferrite resin composite may be significantly different from those of the ferrite substrate thereunder.

Therefore, predictions of coil properties may be difficult, and the coil properties may change significantly, depending on a connection direction of a device.

In addition, since a coil-embedded insulating layer is stacked on a ferrite substrate formed of a brittle ceramic, failures, such as delamination or cracks, may occur between the insulating layer and the ferrite substrate therebelow.

SUMMARY

An exemplary embodiment in the present inventive concept may provide a coil component having a body in which a coil conductor is embedded and a method of fabricating the coil component. The body of the coil component is an isotropic structure having uniform magnetic permeability as a whole, resulting in less variations in characteristics thereof.

According to an exemplary embodiment in the present inventive concept, a coil component may include a core element formed of a magnetic resin composite, a coil conductor embedded in a surface of the core element, and a cover element formed of the same magnetic resin composite as the core element and bonded to the surface of the core element in which the coil conductor is embedded.

Here, the coil conductor may include an upper coil conductor embedded in an upper surface of the core element and a lower coil conductor embedded in a lower surface of the core element. The upper coil conductor and the lower coil conductor may be symmetrical, based on a virtual horizontal center line and may have a trapezoidal cross-section whose width decreases toward the virtual horizontal center line of the coil component.

According to an exemplary embodiment in the present inventive concept, a method of fabricating a coil component may include forming a coil conductor on a carrier layer, pressing the carrier layer to be attached to a core element so that the coil conductor is embedded in a surface of the core element, removing the carrier layer, and bonding a cover element to the surface of the core element in which the coil conductor is embedded.

In addition, the method may further include forming a via on an innermost wire of the coil conductor after the coil conductor is formed. Further, the method may further include curing the core element after the coil conductor is embedded and before the cover element is formed, or curing the core element and the cover element simultaneously, after the cover element is bonded.

BRIEF DESCRIPTION OF DRAWINGS

The above and other aspects, features and advantages of the present inventive concept will be more clearly understood from the following detailed description taken in conjunction with the accompanying drawings, in which.

DETAILED DESCRIPTION

Figure 1:
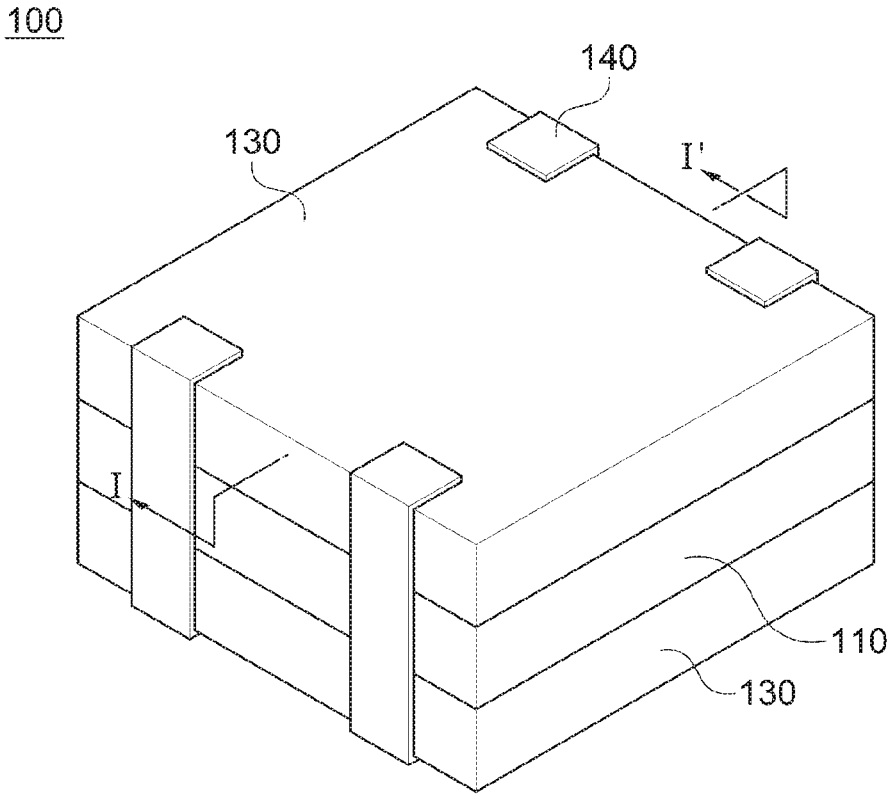
FIG. 1 is a perspective view of a coil component according to an exemplary embodiment of the present inventive concept.

Exemplary embodiments of the present inventive concept will now be described in detail with reference to the accompanying drawings. The inventive concept may, however, be exemplified in many different forms and should not be construed as being limited to the specific embodiments set forth herein. Rather, these embodiments are provided so that this disclosure will be thorough and complete, and will fully convey the scope of the inventive concept to those skilled in the art.

The terminology used herein is for the purpose of describing particular embodiments only and is not intended to be limiting of the present inventive concept. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements, and/or components, but do not preclude the presence or addition of one or more other features, integers, steps, operations, elements, components, and/or groups thereof.

In the drawings, the shapes and dimensions of elements may be exaggerated for clarity, and the same reference numerals will be used throughout to designate the same or like elements. In descriptions of the invention, when it is determined that detailed explanations of related well-known functions or configurations unnecessarily obscure the gist of the invention, the detailed description thereof will be omitted.

Hereinafter, various exemplary embodiments of the present inventive concept will be described more fully with reference to the accompanying drawings.

Figure 2:
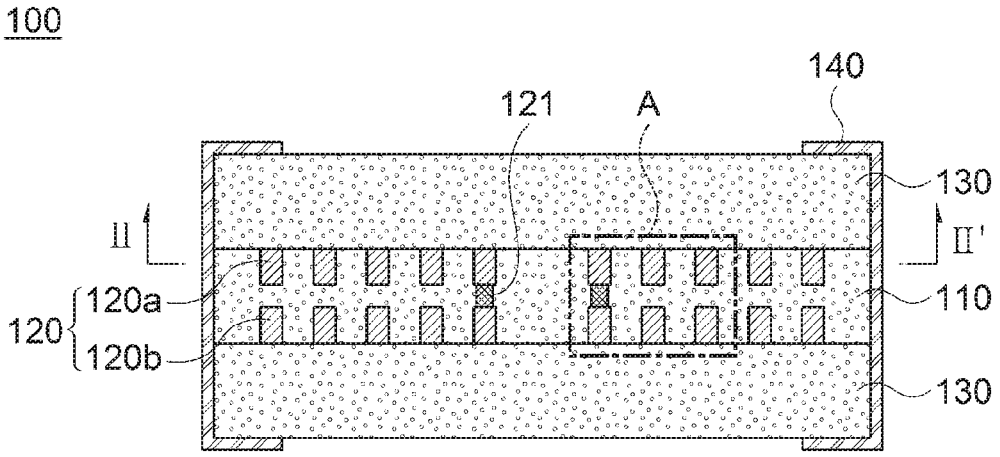
FIG. 2 is a cross-sectional view taken along line I-I' of FIG. 1.
Figure 3:
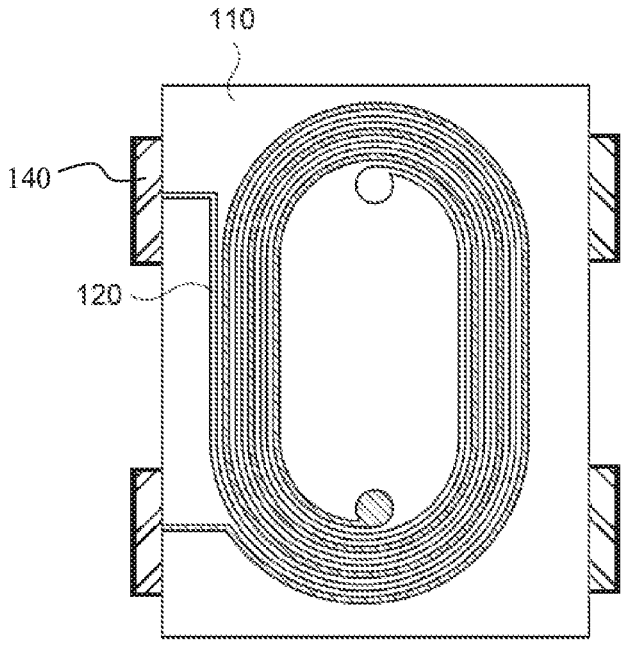
FIG. 3 is a cross-sectional view taken along line II-II' of FIG. 2.

FIG. 1 is a perspective view of a coil component according to an exemplary embodiment of the present inventive concept, FIG. 2 is a cross-sectional view taken along line I-I' of FIG. 1, and FIG. 3 is a cross-sectional view taken along line II-II' of FIG. 2.

Referring to FIGS. 1 to 3, a coil component 100 according to an exemplary embodiment of the present inventive concept may include a core element 110, a coil conductor 120 formed in the core element 110, and a cover element 130 bonded to the core element 110.

The core element 110 is a planar member having a top surface and a bottom surface opposed thereto, and may be formed of a magnetic resin composite in which magnetic powder is mixed with a polymer resin.

Accordingly, the core element 110 may function as a movement path of magnetic flux. Here, the magnetic powder used to secure high magnetic permeability may be, for example, a Ni-based ferrite material, whose main compositions are $Fe_2O_3$ and NiO, a Ni—Zn-based ferrite material, whose main compositions are $Fe_2O_3$, NiO, and ZnO, or a Ni—Zn—Cu-based ferrite material, whose main compositions are $Fe_2O_3$, NiO, ZnO, and CuO. However, the present inventive concept is not limited thereto, and any material can be used without limitation, as long as it has a predetermined amount of inductance.

The coil conductor 120 may be a coil-patterned metal wire wound in a spiral shape, and may be formed of at least one metal selected from the group consisting of silver (Ag), palladium (Pd), aluminum (Al), nickel (Ni), titanium (Ti), gold (Au), copper (Cu), and platinum (Pt), having excellent electrical conductivity.

The coil conductor 120 may be embedded in a surface of the core element 110, and may include an upper coil conductor 120*a* embedded in a top surface of the core element 110 and a lower coil conductor 120*b* embedded in a bottom surface of the core element 110. Here, a structure embedded in a surface may refer to a structure in which bottom and side surfaces of the coil conductor 120 are embedded in the core element 110, and only a top surface of the coil conductor 120 is exposed externally therefrom.

More specifically, the coil conductor 120 may be formed to have, a so called double coil structure in which a first coil wire and a second coil wire are alternately disposed in a single layer. That is, the upper coil conductor 120*a* is formed of a set in which the first coil wire and the second coil wire are alternately disposed, and the lower coil conductor 120*b* may also be formed of another set in which the first coil wire and the second coil wire are alternately disposed.

Here, the first coil wire of the upper coil conductor 120*a* and the first coil wire of the lower coil conductor 120*b* are connected by a via 121 to form a first coil, and the second coil wire of the upper coil conductor 120*a* and the second coil wire of the lower coil conductor 120*b* may be connected by the via 121 to form a second coil.

The first coil and the second coil, disposed to be adjacent to each other, may be electromagnetically coupled. Accordingly, the coil component 100 according to the exemplary embodiment of the present inventive concept may be operated as a common mode filter (CMF) in which levels of magnetic flux are reinforced by each other to increase common mode impedance when currents are applied to the first and second coils in the same direction, and levels of magnetic flux are compensated by each other to decrease differential mode impedance when currents are applied to the first and second coils in opposite directions.

As illustrated in FIG. 3, an end portion of the coil conductor 120, more specifically, the outermost wire in the coil conductor 120 may extend to a side surface of the core element 110 to be exposed and electrically connected to an external terminal 140 formed on a side surface of a body, that is, a laminate of the core element 110 and the cover element 130. Current supplied from an external device through such a connection structure may be applied to the coil conductor 120 via the external terminal 140.

Here, a pair of external terminals 140 that function as an input and an output of the first coil may be opposingly disposed on a left side surface and a right side surface of the body, and another pair of external terminals 140 that function as an input and an output of the second coil may also be disposed in the same structure thereas.

The cover element 130, like the core element 110, is a magnetic member formed of a magnetic resin composite in which magnetic powder is mixed with a polymer resin, and may be disposed to be in contact with the surface of the core element 110 in which the coil conductor 120 is embedded. In this manner, the cover element 130 may configure the outermost part of the coil component 100, and may serve to protect the coil conductor 120 externally by covering the coil conductor 120.

At the same time, the cover element 130, together with the core element 110, may function as a movement path of magnetic flux. That is, the magnetic flux generated when current is applied, may pass through the cover element 130 in a top and a bottom of the coil component 100 and pass through the core element 110 in a center of the coil component 100, and may form a closed magnetic path. Here, the content of magnetic powder in the cover element 130 may be set as the same as the content of magnetic powder in the core element 110.

Thus, directionality of device properties may be improved in the coil component 100 according to the exemplary embodiment of the present inventive concept, since the core element 110 and the cover element 130, configuring a body of a product, are formed of the magnetic resin composite having the same content of magnetic powder.

For example, it is difficult to predict coil characteristics, such as resonance or impedance, in a normal coil component formed of materials having different magnetic properties, and the coil characteristics change depending on a connection direction of a device. However, since the coil component 100 according to the exemplary embodiment of the present inventive concept has an isotropic structure having uniform magnetic permeability as a whole, it is easy to predict the coil characteristics by simulation, and the coil characteristics may not be changed depending on the connection direction of the device.

Figure 4:
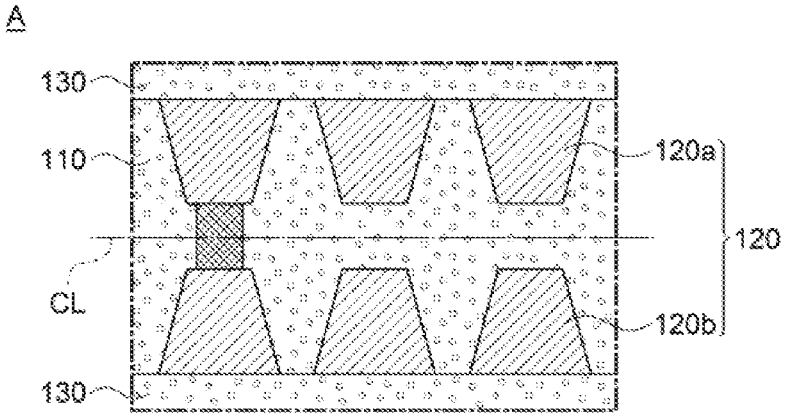
FIG. 4 is an enlarged view of portion A in FIG. 2.

FIG. 4 is an enlarged view of portion A in FIG. 2. Referring to FIG. 4, each of the upper coil conductor 120*a* and the lower coil conductor 120*b* may have a trapezoidal cross-section, and may be disposed to be symmetrical with respect to a virtual horizontal center line CL. Here, the horizontal center line CL refers to a virtual line passing through the center of the core element 110 in a horizontal direction.

The upper coil conductor 120*a* and the lower coil conductor 120*b* may be formed to have a width decreasing toward the horizontal center line CL. That is, a parallel side line having a short length in the trapezoidal cross-section may be disposed to be adjacent to the horizontal center line CL.

Accordingly, the upper coil conductor 120*a* and the lower coil conductor 120, embedded toward the horizontal center line CL, are embedded in an inverted trapezoidal manner with respect to an embedding direction. As a result, adhesion with the core element 110 against external stress may be improved.

Such a structure of the coil conductor 120 is due to a manufacturing method thereof. Hereinafter, a method of fabricating a coil component according to an exemplary embodiment of the present inventive concept will be described.

Figure 5:
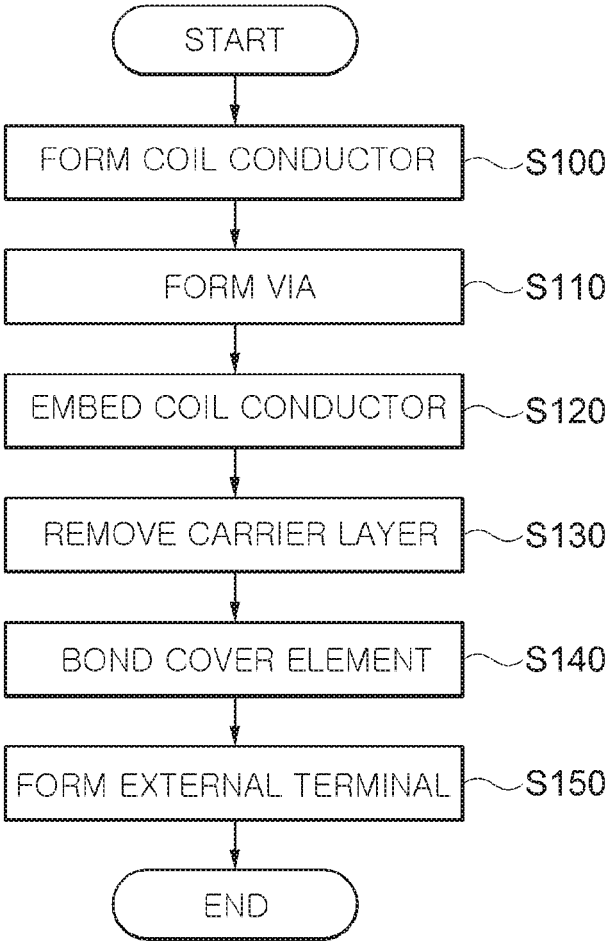
FIG. 5 is a flowchart illustrating a method of fabricating a coil component according to an exemplary embodiment of the present inventive concept, in order.

FIG. 5 is a flowchart illustrating a method of fabricating a coil component according to an exemplary embodiment of the present inventive concept, in order, and FIGS. 6 to 11 are views illustrating respective process operations in FIG. 5.

Figure 6:
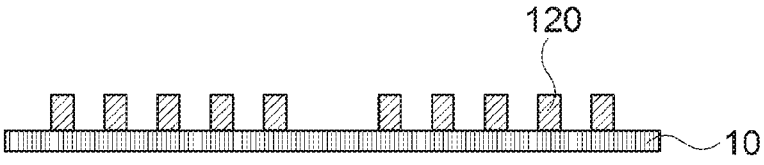
FIGS. 6 to 11 are views illustrating respective process operations of FIG. 5.

As a first operation for fabricating the coil component according to the exemplary embodiment of the present inventive concept, a process of forming a coil conductor 120 on a carrier layer 10 (S100) is performed, as illustrated in FIG. 6.

The carrier layer 10 is a temporary element supporting the coil conductor 120 and may be removed in a subsequent process. The carrier layer 10 may be formed of a different metal to that of the coil conductor 120. For example, when the coil conductor 120 is formed of copper (Cu), the carrier layer 10 may be formed of nickel (Ni).

Here, the coil conductor 120 may be formed using a conventional plating process known in the art, such as a semi-additive process (SAP), a modified semi-additive process (MSAP), or a subtractive method. However, more preferably, the coil conductor 120 may be formed by a photolithography process using a photosensitive metal paste.

The metal paste is a mixture of a conductive metal and an organic vehicle formed of a photosensitive binder, a photopolymerization initiator, a solvent, and the like. Both of a negative type metal paste, a light-receiving portion of which is photo-reacted and remains after developing, and a positive type, a light-receiving portion of which is removed in a developing process, may be used.

The photolithography process using the photosensitive metal paste will be described in detail. First, the carrier layer 10 is coated with the photosensitive metal paste, using a screen printing method, a spray coating method, a roll coating method, or the like. Next, a preferred pattern of a coil conductor 120 may be formed by aligning a mask having a predetermined pattern, radiating light, and performing a developing process to remove unnecessary portions of the photosensitive metal paste. Here, since the amount of absorbed light changes depending on a height of the metal paste coating the carrier layer 10, the coil conductor 120 finished after developing may have a trapezoidal cross-section.

Figure 7:
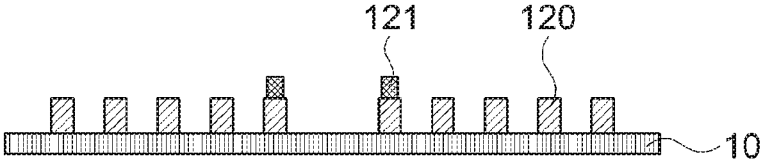

When the coil conductor 120 is formed, a via 121 is formed by coating a top of a wire disposed in a predetermined position, for example, the innermost wire of the coil conductor 120, with a metal paste as illustrated in FIG. 7, in order to connect layers of the coil conductor 120 (S110).

Figure 8:
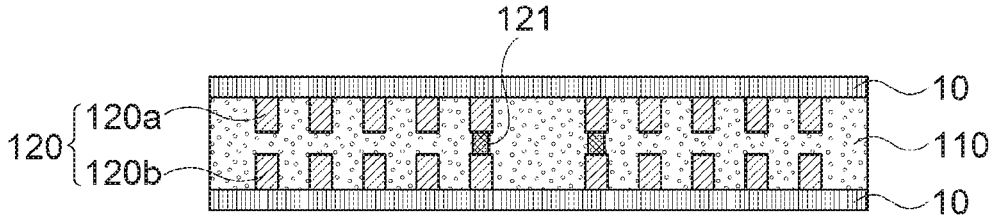

Next, a process of embedding the coil conductor 120 in a surface of a core element 110 (S120) is performed by preparing the core element 110 formed of a magnetic resin composite, arranging the coil conductor 120 to face the core element 110, and pressing the carrier layer 10 to be attached to the core element 110 so that the coil conductor 120 is embedded in the core element 110, as illustrated in FIG. 8.

The core element 110 may be prepared in a B-stage semi-cured state having fluidity. Accordingly, the coil conductor 120 may be easily inserted into the core element 110 during a heat-compressing process.

When the coil conductor 120 is fully embedded in the core element 110, the core element 110 is cured by sintering to fix the coil conductor 120. Alternatively, the core element 110 may be cured together with a cover element 130 bonded to the core element 110 after a subsequent process. Here, a polymer resin may be blended and cured between the core element 110 and the cover element 130, resulting in strengthening of adhesion between the core element 110 and the cover element 130. Unlike those illustrated in FIG. 8, the core element 110 and the cover element 130 may be unified such that an interface therebetween is not distinguishable.

Figure 9:
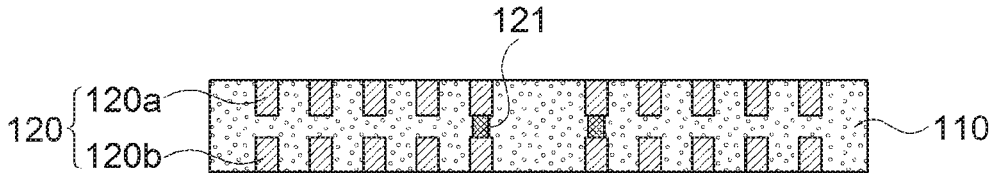

Next, a process of removing the carrier layer 10 by an etching process may be performed as illustrated in FIG. 9 (S130). As described above, since the coil conductor 120 is formed of a different material from the carrier layer 10, the coil conductor 120 may not be etched in the etching process, and thus pattern defects, such as under-cuts, may not be generated.

Figure 10:
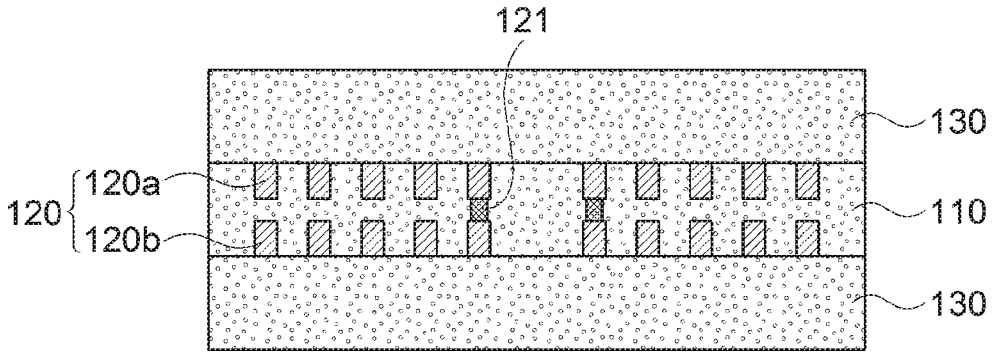

When the carrier layer 10 is removed, a process of bonding the cover element 130 to a surface of the core element 110 in which the coil conductor 120 is embedded, as illustrated in FIG. 10 (S140).

The cover element 130 may be formed of the same magnetic resin composite as the core element 110, bonded in a semi-cured state, and cured by sintering.

In order to design the coil component whose characteristics are not varied according to a connection direction of a device, the cover element 130 bonded to a top of the core element 110 and the cover element 130 bonded to a bottom of the core element 110 may have the same thickness, and the thickness of each cover element 130 may be determined in consideration of the overall thickness of the product. For example, the sum of the thicknesses of the upper and lower cover elements 130 may be determined by subtracting a thickness of the core element 110 from the overall thickness of the product.

In this manner, according to the exemplary embodiment of the present inventive concept, a product matching a required size may be fabricated by adjusting the thickness of the cover element 130. Accordingly, a process yield may be improved and a light, thin, short, and small product may be implemented.

Figure 11:
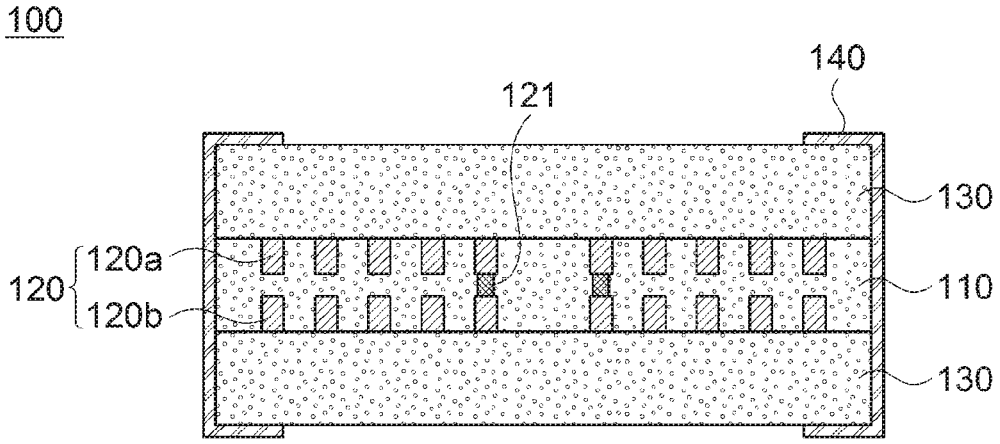

When the cover element 130 is bonded, the coil component 100 according to the exemplary embodiment of the present inventive concept may be finally completed by forming an external terminal 140 on a portion corresponding to an end portion of the coil conductor 120 exposed on a side surface of the body, as illustrated in FIG. 11 (S150).

As set forth above, according to the exemplary embodiments of the present inventive concept, the directionality of device properties may be improved since a core element and a cover element, configuring a body of a coil component, are formed of the same material. Accordingly, device characteristics may be easily predicted, and the device characteristics may not be changed regardless the direction in which the coil component is connected.

In addition, since the core element and the cover element, formed of the same material, are integrally formed, common failures, such as delamination or cracks, may be suppressed, and thereby product reliability may be improved.

While exemplary embodiments have been shown and described above, it will be apparent to those skilled in the art that modifications and variations could be made without departing from the scope of the invention as defined by the appended claims.

What is claimed is:

1. A coil component, comprising:

a core element;

a coil conductor embedded in the core element; and a cover element bonded to a surface of the core element in which the coil conductor is embedded, wherein the coil conductor includes:

an upper double coil structure including a first coil conductor and a second coil conductor alternately disposed in a single layer, the first and second coil conductors each embedded in and contacting an upper surface of the core element, a lower double coil structure including a third coil conductor and a fourth coil conductor alternately disposed in another single layer, the third and fourth coil conductors each embedded in and contacting a lower surface of the core element, and vias configured to connect the first coil conductor of the upper double coil structure and the third coil conductor of the lower double coil structure, and to connect the second coil conductor of the upper double coil structure and the fourth coil conductor of the lower double coil structure, and wherein the first, second, third, and fourth coil conductors each have a trapezoidal cross-section whose width decreases from a surface of the core element contacted by the first, second, third, or fourth coil conductor, respectively, toward a virtual horizontal center line of the coil component.

2. The coil component of claim 1, wherein the core element and the cover element are formed of a magnetic resin composite.

3. The coil component of claim 1, wherein a content of magnetic powder included in the core element is the same as a content of magnetic powder included in the cover element.

4. The coil component of claim 1, wherein the upper double coil structure and the lower double coil structure are symmetrical, based on a virtual horizontal center line of the coil component.

5. The coil component of claim 1, wherein an entire portion between the upper and lower double coil structures, except the vias, and the cover element are formed of a same magnetic resin composite.

6. The coil component of claim 1, further comprising first, second, third, and fourth external terminals each electrically connected to an end of a corresponding one of the first, second, third, and fourth coil conductors exposed externally.

7. The coil component of claim 1, wherein the vias connect the first and third coil conductors, and the second and fourth coil conductors, such that levels of magnetic flux produced by current flow through the coil conductors are reinforced by each other to increase common mode impedance when currents are applied to the first and second coil conductors in the same direction, and levels of magnetic flux are compensated by each other to decrease differential mode impedance when currents are applied to the first and second coil conductors in opposite directions.

8. The coil component of claim 1, wherein the cover element includes an upper cover element contacting the upper surface of the core element and a lower cover element contacting the lower surface of the core element.

9. The coil component of claim 8, wherein the upper cover element contacts the upper double coil structure and the lower cover element contacts the lower double coil structure.

10. A coil component, comprising:

a core element;

upper and lower cover elements respectively bonded to opposite upper and lower surfaces of the core element;

upper and lower double coil structures embedded in the core element, the upper double coil structure forming first and second upper coils contacting the upper surface of the cover element and the lower double coil structure forming third and fourth lower coils contacting the lower surface of the cover element, and the upper and lower double coil structures respectively covered by the upper and lower cover elements; and vias configured to connect the first coil conductor of the upper double coil structure and the third coil conductor of the lower double coil structure, and to connect the second coil conductor of the upper double coil structure and the fourth coil conductor of the lower double coil structure, wherein the first and second upper coils of the upper double coil structure and the third and fourth lower coils of the lower double coil structure each has a trapezoidal cross-section whose width decreases toward the via connected thereto.

11. The coil component of claim 10, wherein the core element and the upper and lower cover elements are formed of the same material.

12. The coil component of claim 10, wherein any non-conductive portion between the upper and lower double coil structures, and the upper and lower cover elements, are formed of a same magnetic resin composite.

13. The coil component of claim 10, wherein the upper cover element contacts the upper double coil structure and the lower cover element contacts the lower double coil structure.

14. The coil component of claim 10, wherein the vias connect the first and third coil conductors, and the second and fourth coil conductors, such that levels of magnetic flux produced by current flow through the coil conductors are reinforced by each other to increase common mode impedance when currents are applied to the first and second coil conductors in the same direction, and levels of magnetic flux are compensated by each other to decrease differential mode impedance when currents are applied to the first and second coil conductors in opposite directions.

* * * * *